US009557025B2

(12) United States Patent
Lee

(10) Patent No.: US 9,557,025 B2
(45) Date of Patent: Jan. 31, 2017

(54) LIGHTING APPARATUS FOR VEHICLE

(71) Applicant: Hyundai Motor Company, Seoul (KR)

(72) Inventor: Seong Hoon Lee, Whasung-Si (KR)

(73) Assignee: Hyundai Motor Company, Seoul (KR)

( * ) Notice: Subject to any disclaimer, the term of this patent is extended or adjusted under 35 U.S.C. 154(b) by 105 days.

(21) Appl. No.: 14/548,139

(22) Filed: Nov. 19, 2014

(65) Prior Publication Data

US 2016/0003434 A1 Jan. 7, 2016

(30) Foreign Application Priority Data

Jul. 1, 2014 (KR) ..... 10-2014-0081709

(51) Int. Cl.
*F21S 8/10* (2006.01)
*F21V 13/04* (2006.01)
*F21W 101/00* (2006.01)

(52) U.S. Cl.
CPC ..... *F21S 48/00* (2013.01); *F21S 48/1258* (2013.01); *F21S 48/1283* (2013.01); *F21S 48/1323* (2013.01); *F21S 48/1388* (2013.01); *F21S 48/145* (2013.01); *F21V 13/04* (2013.01); *F21W 2101/00* (2013.01)

(58) Field of Classification Search
CPC ..... F21S 48/00; F21S 48/145; F21S 48/1258; F21S 48/1283; F21S 48/1323; F21S 48/1388; F21V 13/04; F21W 2101/00
See application file for complete search history.

(56) References Cited

U.S. PATENT DOCUMENTS

2010/0110716 A1* 5/2010 Nakada ..... F21S 48/1159 362/538

FOREIGN PATENT DOCUMENTS

| | | | |
|---|---|---|---|
| JP | 2002-109916 | A | 4/2002 |
| JP | 2009-104790 | A | 5/2009 |
| JP | 2011-238470 | A | 11/2011 |
| JP | 2013-51178 | A | 3/2013 |
| KR | 10-2009-0032578 | A | 4/2009 |
| KR | 10-2009-0118873 | A | 11/2009 |
| KR | 10-2010-0042810 | A | 4/2010 |

* cited by examiner

*Primary Examiner* — Stephen F Husar
(74) *Attorney, Agent, or Firm* — Morgan, Lewis & Bockius LLP

(57) ABSTRACT

A lighting apparatus for a vehicle may include a reflector configured to reflect light generated from a light source forward, a lens configured to be disposed in front of the reflector to receive the light reflected from the reflector, a first reflecting body configured to be disposed between the lens and the reflector to receive light not received in the lens among the light reflected from the reflector, and a second reflecting body configured to guide the light reflected from the first reflecting body to the lens.

11 Claims, 3 Drawing Sheets

LIGHTING APPARATUS FOR VEHICLE

CROSS REFERENCE TO RELATED APPLICATION

The present application claims priority to Korean Patent Application No. 10-2014-0081709, filed Jul. 1, 2014, the entire contents of which is incorporated herein for all purposes by this reference.

BACKGROUND OF THE INVENTION

Field of the Invention

The present invention relates to a lighting apparatus for a vehicle, and more particularly, to a lighting apparatus for a vehicle capable of improving reflecting efficiency of light generated from a light source.

Description of Related Art

Generally, as illustrated in FIG. 1, a lighting apparatus for a vehicle is configured to include a light source 10 generating light, a reflector 20 refracting the light generated from the light source 10 forward, and a lens 30 refracting light reflected from the reflector 20 to be able to irradiate light within a set light distribution range.

A direction of light is changed depending on a divergence direction of light from the light source 10, an angle of a reflecting surface of the reflector 20, a refractive index of the lens 30, and thus the introduced amount of the light generated from the light source 10 into the lens 30 is changed.

The existing lighting apparatus reckons only light, which is reflected from the reflector 20 and incident on the lens 30 among the light generated from the light source 10, as effective light and has used only the light for actual irradiation of light, but since the amount of light which is reflected from the reflector 20 but is not incident on the lens or the extinction amount of light without being reflected from the reflector 20 is large, has a problem in that efficiency of light generated from the light source may be degraded.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a lighting apparatus for a vehicle which may extend a length of a reflector and include a plurality of reflecting bodies to again reflect light reflected from the extended portion to a lens.

According to an aspect of the present invention, there is provided a lighting apparatus for a vehicle, including a reflector configured to reflect light generated from a light source forward, a lens configured to be disposed in front of the reflector to receive the light reflected from the reflector, a first reflecting body configured to be disposed between the lens and the reflector to receive light not received in the lens among the light reflected from the reflector, and a second reflecting body configured to guide the light reflected from the first reflecting body to the lens.

The reflector may include an extension extended forward to reflect light which is reflected from the reflector and then not incident on the lens among the light generated from the light source.

A first reflecting body may be positioned between a first focus through which the light reflected from the reflector passes and the extension.

The first reflecting body may be positioned on a moving path along which light irradiated from the extension directs to the first focus to reflect the light irradiated from the extension and may be not positioned on the moving path of light directing to the lens among the light reflected from the reflector.

The first reflecting body may irradiate light so that a second focus through which the light reflected from the first reflecting body passes is adjacently positioned to a virtual line generated by more extending the extension forward.

One end of the second reflecting body may be coupled with an end of a lens side of the extension.

The first reflecting body may irradiate light so that the second focus through which the light reflected from the first reflecting body passes is positioned between the first reflecting body and the second reflecting body.

A back surface of the lens on which the light reflected from the reflector is incident may be provided with a refraction part to refract a moving path of the light reflected from the second reflecting body.

An angle between a light incident surface of the refraction part on which light is incident and a light emitting surface thereof from which light is emitted and an angle between the light emitting surface and the lens may be set so that when the light incident on the refraction part transmits the lens and is irradiated forward, the irradiated light may be included within a preset light distribution range of the lens.

The refraction part may be continuously formed along a circumferential part of the lens and may be positioned within a range of the circumferential part of the lens in which a quantity of light incident on a circumferential part of the lens is equal to or less than a set quantity of light with respect to a total quantity of light incident on the lens.

The refraction part may be a prism having a plurality of refraction surfaces.

The reflector may include an oval reflecting surface.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
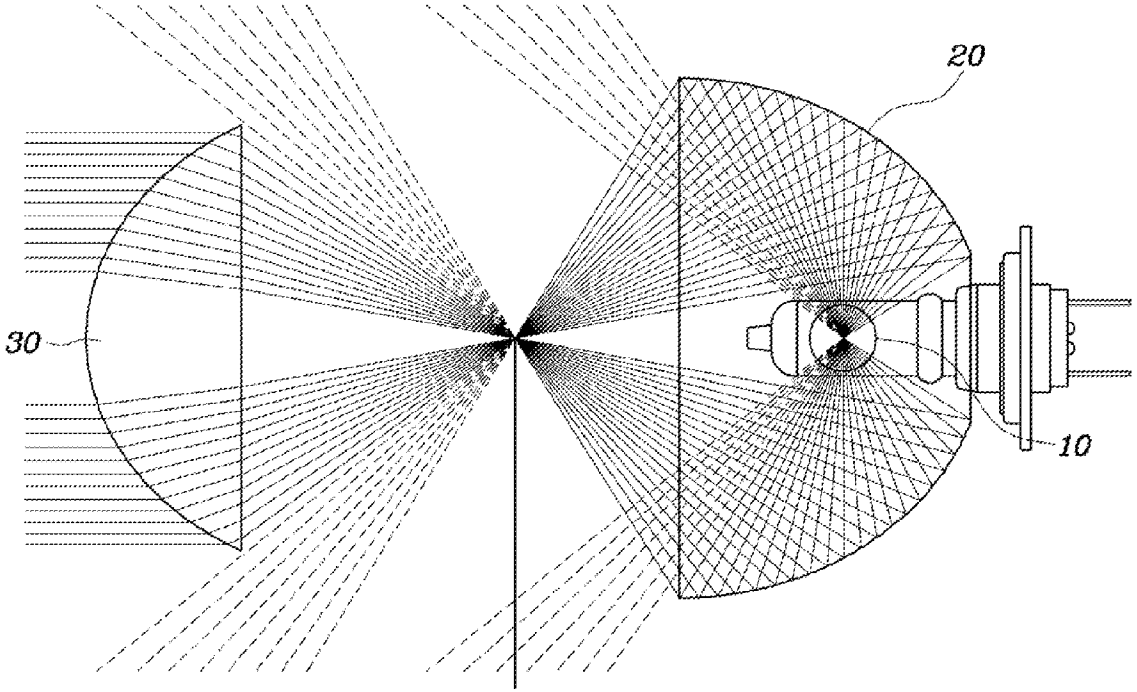
FIG. 1 (Prior Art)
FIG. 1 is a configuration diagram of a lighting apparatus for a vehicle according to the related art.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, a lighting apparatus for a vehicle according to exemplary embodiments of the present invention will be described with reference to the accompanying drawings.

Figure 2:
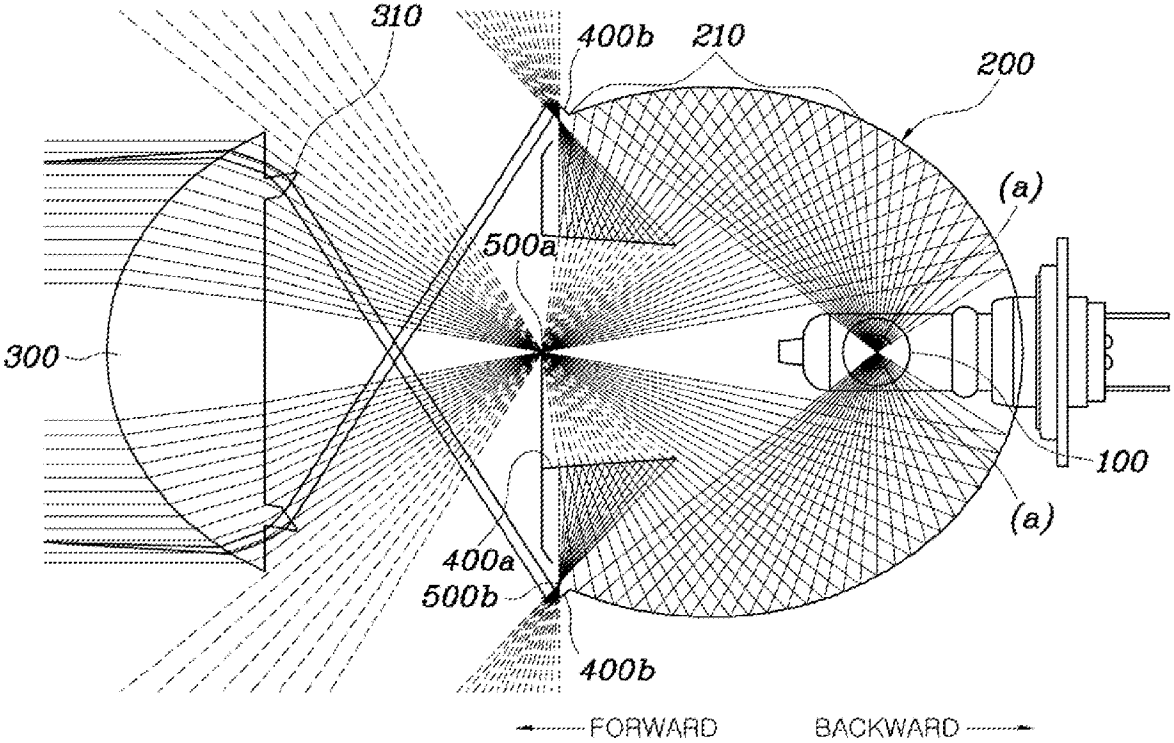
FIG. 2 is a side cross-sectional view of a lighting apparatus for a vehicle according to an exemplary embodiment of the present invention.
Figure 3:
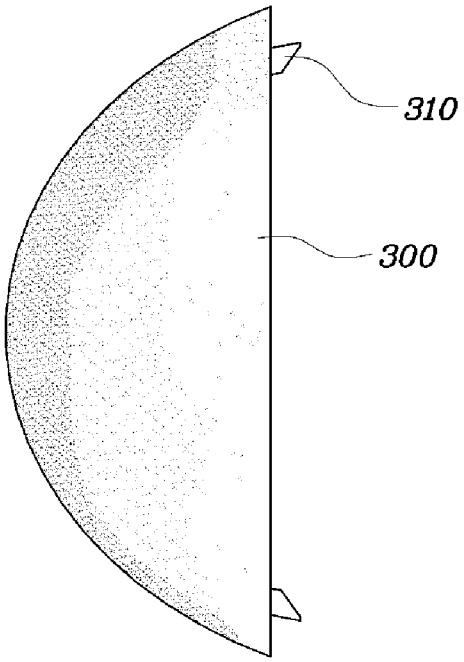
FIG. 3 is a diagram illustrating a distribution of light incident on a lens.

FIG. 2 is a side cross-sectional view of a lighting apparatus for a vehicle according to an exemplary embodiment of the present invention and FIG. 3 is a diagram illustrating a distribution of light incident on a lens.

As illustrated in FIG. 2, the lighting apparatus for a vehicle according to the exemplary embodiment of the present invention includes a reflector 200 reflecting light generated from a light source 100 forward, a lens 300 disposed in front of the reflector 200 to receive the light reflected from the reflector 200, a first reflecting body 400*a* disposed between the lens 300 and the reflector 200 to receive light not received in the lens 300 among the light reflected from the reflector 200, and a second reflecting body 400*b* guiding the light reflected from the first reflecting body 400*a* to the lens 300.

In detail, as the light source 100, various lamps such as an LED lamp and a halogen lamp may be selected according to a designer's intention and the reflector 200 may be disposed to have a reflecting surface formed in a form enclosing back and side portions of the light source 100 from the back portion of the light source 100 and have a front portion opened so as to reflect and irradiate the light generated from the light source 100 forward, in which the reflecting surface is preferably formed in an oval reflecting surface not to form an image according to a bending of the reflecting surface on the light irradiated forward. Further, the reflecting surface is not limited to an oval reflecting surface and therefore may be changed to various forms such as a form in which a plurality of planar reflecting surfaces are continuously connected with a set angle.

Further, the reflector 200 may include an extension 210 extended forward so that the reflector 200 may reflect the rest light other than the light reflected from the reflector 200 and incident on the lens 300 among the light generated from the light source 100.

A length of the extension 210 extended forward may be variously set depending on an irradiation angle (a) of the light generated from the light source 100. The irradiation angle (a) means an angle of light diverged to the side portion of the light source 100, that is, the reflector 200 side, other than the light irradiated in front and back directions among the light generated from the light source 100. In this case, when the irradiation angle (a) of the light source 100 is increased, the angle range of the light irradiated forward is widened, and therefore the length of the extension 210 needs to be extended so as to accommodate the angle range. To the contrary, as the irradiation angle (a) of the light irradiated from the light source 100 is narrow, it is enough to reflect only light within a limited range, and therefore the length of the extension 210 may be limited.

The extension 210 may maintain the form of the oval reflecting surface of the reflector 200 enclosing the light source 100 and the reflecting surface form, angle, bent degree, and the like of the reflector 200 may be set so that all the light reflected from the reflector 200 including the extension 210 is converged into a preset first focus 500*a*. For example, as illustrated in FIG. 2, the reflector 200 may be formed so that the parabola which starts from the back portion of the light source 100 and has an increasingly widening cross sectional area is drawn and then a cross sectional area of a parabola is increasingly narrow at a specific time. A starting time to make the cross sectional area be increasingly narrow may be variously set depending on a position of the first focus 500*a* and the irradiation angle at which the light from the light source 100 is irradiated. Further, the position of the first focus 500*a* may be variously set depending on a shape of the reflector 200 and the lens 300 and a distance between the reflector 200 and the lens 300, a refractive index of the lens 300, and the like.

Meanwhile, the first reflecting body 400*a* may be positioned between the first focus 500*a* into which the light reflected from the reflector 200 is converged and the extension 210.

In detail, the first reflecting body 400*a* is radially disposed at an outer side of the first focus 500*a* and the reflector 200 is radially disposed at an outer side of the first reflecting body 400*a* and thus may be positioned between the first focus 500*a* and the extension 210.

In particular, the first reflecting body 400*a* may be variously formed but is formed to include a cylindrical or semi-cylindrical planar reflecting surface, the planar reflecting surface is positioned on a moving path along which the light irradiated from the extension 210 directs to the first focus 500*a* to reflect the light irradiated from the extension 210, and the first reflecting body 400*a* is not preferably positioned on a moving path of the light directing to the lens 300 among the light reflected from the reflector 200.

The reason is that light incident on the lens 300 is maximally secured and light which is not incident on the lens 300 is maximally reflected to be incident on the lens 300 through the second reflecting body.

Further, an angle of the planar reflecting surface of the first reflecting body 400*a* is preferably set so that the light reflected from the first reflecting body 400*a* passes through a preset second focus 500*b* and it is preferable that the second focus 500*b* is consistently or adjacently positioned to a virtual line generated by more extending the extension 210 forward. For the second focus 500*b* to be consistently or adjacently positioned to the virtual line generated by more extending the extension 210 forward, the first reflecting body 400*a* may also adjust the angle of the planar reflecting surface or may also change the form of the reflecting surface such as the bent reflecting surface as described above and may also change the distance between the first focus 500*a* and the reflector 200.

As the second focus 500*b* is adjacently positioned to the virtual line, the existing lighting apparatus frame designating the position of the light source 100, the lens 300 and the reflector 200 may be maintained and additional costs due to the change in frame may be saved.

Meanwhile, the second reflecting body 400*b* may be provided in a ring shape in which one end of the second reflecting body 400*b* is coupled along an end of lens 300 side of the extension 210, that is, an end of the lens 300 side of the reflector 200. The coupling method may be various set such as welding and bolting or the second reflecting body 400*b* may also be formed by being integrally molded with the extension 210.

In detail, the second reflecting body 400*b* is provided at a position corresponding to the second focus 500*b* and thus may again reflect light reflected from the first reflecting body 400*a* and passing through the second focus 500*b* to the lens 300. To this end, a width of the second reflecting body 400*b*, a gradient and a refraction degree of the reflecting surface, and the like may be variously set depending on characteristics of the incident light and a direction of light to be transmitted and the shape of the second reflecting body 400*b* may also be variously formed.

The second focus 500*b* is adjacently positioned to the virtual line and the second reflecting body 400*b* is extended while being coupled with the end of the lens 300 side of the extension 210, and therefore a layout may be simplified.

Meanwhile, a back surface of the lens 300 on which the light reflected from the reflector 200 is incident may be provided with a refraction part 310 which refracts the moving path of the light reflected from the second reflecting body 400*b*.

That is, the second reflecting body 400*b* is set to irradiate the light incident from the first reflecting body 400*a* to the refraction part 310 and the light reflected from the second reflecting body 400*b* is incident on the refraction part 310 and is refracted and then is irradiated forward through the lens 300.

The refraction part 310 may include a plurality of refraction surfaces as a form of a prism to refract the light incident from the second reflecting body 400*b* and then make the refracted light be incident on the lens 300 and may be made of the same material as the lens 300 to be integrally molded with the lens 300. This may adopt the existing production method as it is without adding the separate production process and is advantageous in costs. However, the refraction part 310 is not necessarily limited to the prism, but may also be formed in a form of a reflecting mirror performing the same object and therefore is not limited to any one configuration in terms of the form. As a result, even though the refraction part 310 is provided in the form of the prism, a material thereof may be different from that of the lens 300.

Further, the refraction part 310 is continuously formed along a circumferential part of the lens 300 and is preferably positioned within a range of the circumferential part of the lens in which a quantity of light incident on the circumferential part of the lens 300 is a set quantity of light with respect to a total quantity of light incident on the lens 300, for example, equal to or less 5%. FIG. 3 is a diagram illustrating a distribution of light incident on the lens 300, in which since it may be confirmed that the light incident on the circumferential part of the lens 300 is about 2 to 5% of the total quantity of light incident on the overall lens 300, the refraction part 310 is provided at a portion at which a quantity of light is insufficient to make light be additionally incident on the circumferential part, thereby effectively distributing light.

In this case, the back surface of the lens 300 is planar and the front surface thereof is preferably a bent aspherical lens but is not necessarily limited thereto.

Meanwhile, the refraction part 310 preferably has the refraction surface to refract the moving path of light so that when the light incident on the refraction part 310 transmits the lens 300, the incident light is included within the preset light distribution range of the lens 300.

The light distribution range means a range in which the light finally emitted from the lens 300 is irradiated forward, in which the light distribution range may be variously set according to a type of a vehicle and a designer's intention and legal limiting factors for setting the light distribution range may be considered.

Therefore, an angle between a light incident surface of the refraction part 310 on which light is incident and a light emitting surface thereof from which light is emitted and an angle between the light emitting surface and the lens 300 may be set so that, when the light incident from the second reflecting body 400*b* passes through the lens 300, the incident light is included within the light distribution range.

According to the lighting apparatus for a vehicle having the above-mentioned structure, the light efficiency may be increased and thus the brightness of light irradiated to the road surface may be increased and the amount of energy consumed by the light source may be reduced and thus the fuel efficiency may be increased.

Further, the brightness of light irradiated to the road surface may be increased without replacing the light source and thus the production costs may be saved.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A lighting apparatus for a vehicle, comprising:

a reflector configured to reflect light generated from a light source forward;

a lens disposed in front of the reflector to receive the light reflected from the reflector;

a first reflecting body disposed between the lens and the reflector to receive light not received in the lens among the light reflected from the reflector; and a second reflecting body configured to guide the light reflected from the first reflecting body to the lens, wherein a back surface of the lens on which the light reflected from the reflector is incident is provided with a refraction part to refract a moving path of the light reflected from the second reflecting body.

2. The lighting apparatus for the vehicle of claim 1, wherein the reflector includes an extension extended forward to reflect light which is reflected from the reflector and then not incident on the lens among the light generated from the light source.

3. The lighting apparatus for the vehicle of claim 2, wherein the first reflecting body is positioned between a first focus through which the light reflected from the reflector passes and the extension.

4. The lighting apparatus for the vehicle of claim 3, wherein the first reflecting body is positioned on a moving path along which light irradiated from the extension directs to the first focus to reflect the light irradiated from the extension and is not positioned on a moving path of light directing to the lens among the light reflected from the reflector.

5. The lighting apparatus for the vehicle of claim 1, wherein the first reflecting body irradiates light so that a second focus through which the light reflected from the first reflecting body passes is adjacently positioned to a virtual line generated by more extending an extension forward.

6. The lighting apparatus for the vehicle of claim 2, wherein one end of the second reflecting body is coupled with an end of a lens side of the extension.

7. The lighting apparatus for the vehicle of claim 1, wherein the first reflecting body irradiates light so that a second focus through which the light reflected from the first reflecting body passes is positioned between the first reflecting body and the second reflecting body.

8. The lighting apparatus for the vehicle of claim 1, wherein an angle between a light incident surface of the refraction part on which light is incident and a light emitting surface thereof from which light is emitted and an angle between the light emitting surface and the lens are set so that, when the light incident on the refraction part transmits the lens and is irradiated forward, the irradiated light is included within a preset light distribution range of the lens.

9. The lighting apparatus for the vehicle of claim 1, wherein the refraction part is continuously formed along a circumferential part of the lens and is positioned within a range of the circumferential part of the lens in which a quantity of light incident on the circumferential part of the lens is equal to or less than a set quantity of light with respect to a total quantity of light incident on the lens.

10. The lighting apparatus for the vehicle of claim 1, wherein the refraction part is a prism having a plurality of refraction surfaces.

11. The lighting apparatus for the vehicle of claim 1, wherein the reflector includes an oval reflecting surface.

* * * * *